US009909345B1

(12) United States Patent
Mason

(10) Patent No.: US 9,909,345 B1
(45) Date of Patent: Mar. 6, 2018

(54) DOOR WEDGE SYSTEM AND METHOD OF USE

(71) Applicant: Stephen Mason, Owasso, OK (US)

(72) Inventor: Stephen Mason, Owasso, OK (US)

( * ) Notice: Subject to any disclaimer, the term of this patent is extended or adjusted under 35 U.S.C. 154(b) by 0 days.

(21) Appl. No.: 15/334,610

(22) Filed: Oct. 26, 2016

Related U.S. Application Data

(60) Provisional application No. 62/246,177, filed on Oct. 26, 2015.

(51) Int. Cl.
*E05C 17/54* (2006.01)

(52) U.S. Cl.
CPC ..... *E05C 17/54* (2013.01)

(58) Field of Classification Search
CPC ..... E05C 17/54
USPC ..... 16/82
See application file for complete search history.

(56) References Cited

U.S. PATENT DOCUMENTS 349,688 A * 9/1886 Buckingham ..... E05C 19/004 292/339
693,740 A * 2/1902 Raether ..... E05C 17/54 292/343
971,717 A * 10/1910 Bates ..... E05C 17/54 292/343
1,042,329 A * 10/1912 Daniels ..... E05C 17/54 144/24.22
1,166,009 A * 12/1915 Schneider ..... E05C 17/54 254/39
1,555,129 A * 9/1925 Lipsius ..... E05C 17/54 292/343
2,647,782 A * 8/1953 Fisk ..... E05C 17/54 292/288
5,492,381 A * 2/1996 Waters ..... E05C 17/50 292/229
9,115,517 B2 * 8/2015 Clay ..... E05C 17/54

* cited by examiner

*Primary Examiner* — Matthieu F Setliff
*Assistant Examiner* — Thomas Neubauer
(74) *Attorney, Agent, or Firm* — Richard G. Eldredge; Eldredge Law Firm

(57) ABSTRACT

A door stop includes a base with a first side member and a second side member extending parallel relative to the first side member; and a joining member integral with the first side member and the second side member that form a c-shaped configuration with an opening. The door stop further includes an elongated rigid body pivotally attached to the first side member and the second side member, the elongated rigid member is configured to fit within the opening; a first groove extending a partial length of a thickness of the first member; a second groove extending a partial length of a thickness of the second member; a first tab extending from the elongated rigid body and configured to rest within the first groove; a second tab extending from the elongated rigid body and configured to rest within the second groove; and a pivot joint having a rod that extend through the first member, through the elongated rigid body, and through the second member.

1 Claim, 3 Drawing Sheets

DOOR WEDGE SYSTEM AND METHOD OF USE

BACKGROUND

1. Field of the Invention

The present invention relates generally to door stops.

2. Description of Related Art

Door stops are well known in the art and are effective means to hold a door in an open and/or closed position. A commonly known door stop is a conventional wedge shaped apparatus. FIG. 1 is a door stop 101 having a flat bottom base 102 configured to engage with the ground surface (not shown), a back 104, and a wedge surface 106 extending from the back 104 to the base 102 at a sloped angle. During use, the wedge surface 106 fits underneath the door and is pushed thereagainst for friction locking.

One of the problems commonly associated with the wedge shaped door stop 101 is the limited use. For example, it is rather inconvenient to travel with in some application. It should be understood that persons hired to use such devices, e.g., persons working in a hotel, often travel with the device and are required to either hold the device in the hands or back pocket. Accordingly, the device becomes cumbersome to use.

It should be understood that there is a long-felt need for a simplified door stop that can be easily carried on the person and readily available for use.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
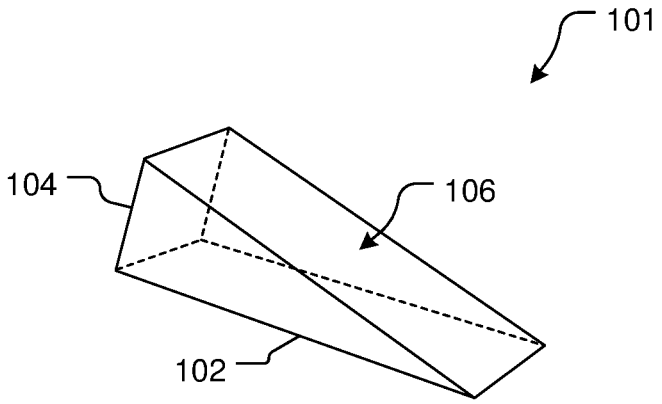
FIG. 1 (Prior Art)
FIG. 1 is a simplified schematic of a commonly known door stop.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional door stops. Specifically, the system and method of the present application provides rapid and effective means to carry the door stop in the back pocket of the user and is speedily assembled for use. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 2-6 depict various views of the door stop system 201 and method of use in accordance with a preferred embodiment of the present application. It will be appreciated that system 201 overcomes one of more of the above-listed problems commonly associated with the conventional door stops.

In the contemplated embodiment, system 201 includes one or more of base 103 hingedly attached to a wedge assembly 105 about a pivot joint 107. As shown specifically in FIGS. 2 and 3, the wedge assembly 105 is configured to pivot relative to the base 103 in direction "A" between an angled upright position to a flat folded position. Accordingly, the system 201 provides means for easily transport while in the flat position, and effective means to retain the door in position while in the angled upright position.

Base 103 includes three integral members: a first side member 109, a second side member 113, and a joining member 111, which in turn form a "U-shaped" opening 203 adapted to match and receive the wedge assembly 105 therein.

In the exemplary embodiment, the base 103 includes a bottom surface 205 that comes into contact with the ground surface and keeps the system 201 in a stationary position during use. Although not shown, it is contemplated having surface treatments to increase the friction between the ground and surface 205 to prevent slippage. The base 103 also includes a top surface 117 that is flush with the top surface 405 of the wedge assembly 105 in the folded position.

Figure 2:
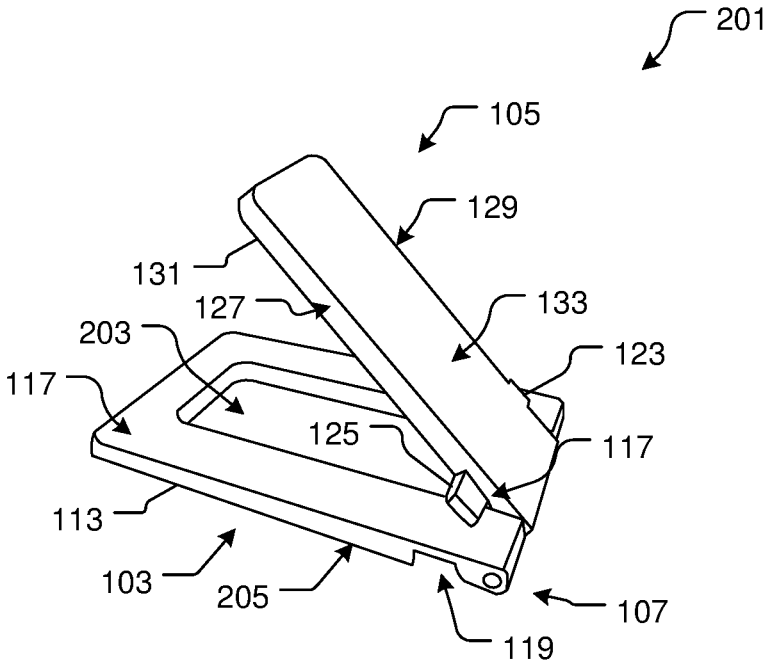
FIG. 2 is an oblique open view of a door stop system and method of use in accordance with a preferred embodiment of the present application.
Figure 3:
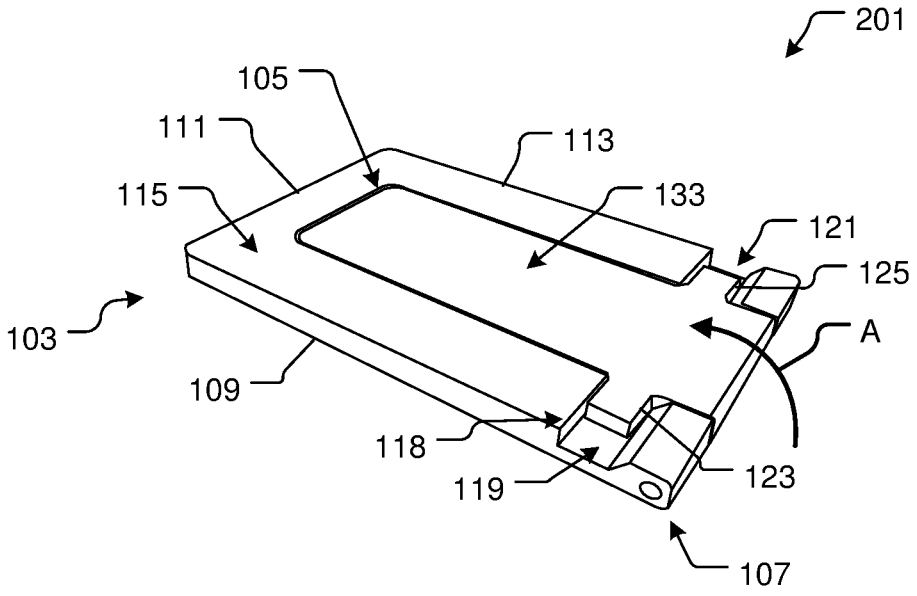
FIG. 3 is an oblique closed view of the door stop of FIG. 2.

System 201 is provided with a locking mechanism 118, which comprises of grooves 119, 121 on respective members 109, 113 and two tabs 123, 125 that extend from respective surfaces 129, 127 of the wedge assembly 105. As shown in FIG. 2, the tabs fit within the grooves in the folded position and rest against surface 117 while in the angled upright position. The tabs are configured to retain the wedge assembly at an angle relative to the base during use.

Wedge assembly 105 is provided with a rigid body 131 having a top surface 133 that comes into contact with the door and a bottom surface 401. Although shown devoid of surface treatments, it is contemplated having one or more types of treatments on surface 133 in alternative embodiments to increase the friction lock between body 131 and the door.

Figure 4:
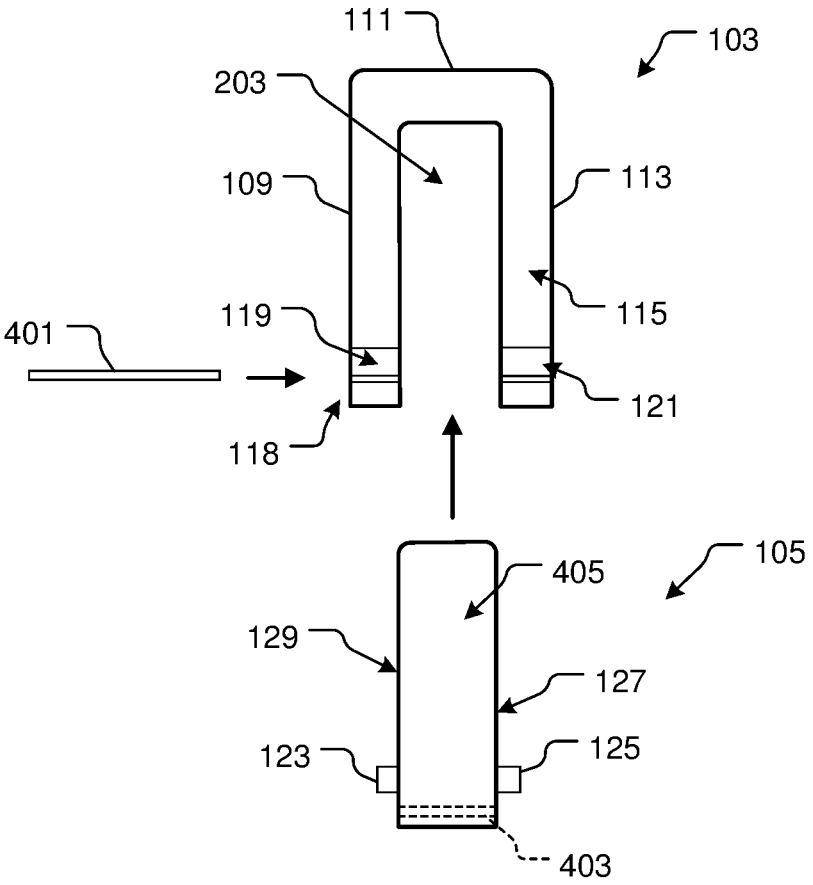
FIG. 4 is a disassembled top view of the door stop of FIG. 2.
Figure 5:
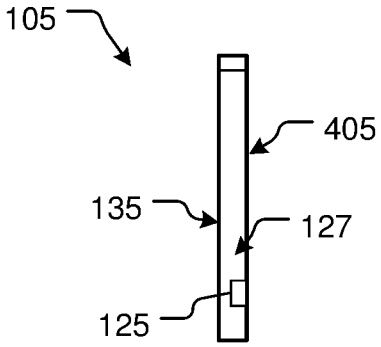
FIG. 5 is a side view of the wedge assembly of the door stop of FIG. 2.
Figure 6:
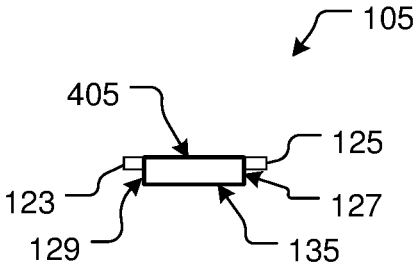
FIG. 6 is a front view of the wedge assembly of FIG. 5.

Referring specifically to FIG. 4, a dissembled view of system 201 is shown. In the contemplated embodiment, the system 201 utilizes a pin 401 configured to engage with the base 103 and wedge assembly 105 via a channel 403 extending through both the base and wedge assembly. However, it will be appreciated that alternative embodiments could include different types of pivoting means in lieu of the exemplary embodiment.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A door stop, comprising:

a base with an upper surface and a bottom surface, the base having:

a first side member and a second side member extending parallel relative to the first side member; and a joining member integral with the first side member and the second side member;

wherein the first side member, the second side member, and the joining member form a c-shaped configuration with an opening recessed between the first side member and the second side member;

an elongated rigid body pivotally attached to the first side member and the second side member, the elongated rigid member is configured to fold flat and fit within the opening;

wherein a top surface of the elongated rigid body is flush with the upper surface of the base as the elongated rigid body is in a folded position;

a first groove extending a partial length of a thickness of the first member, the first groove being recessed to a same depth as the opening;

a second groove extending a partial length of a thickness of the second member, the second groove being recessed to a same depth as the opening;

a first tab extending from the elongated rigid body and configured to rest within the first groove;

a second tab extending from the elongated rigid body and configured to rest within the second groove; and a pivot joint having a rod that extend through the first member, through the elongated rigid body, and through the second member;

wherein the pivot joint is configured to enable the elongated rigid body to pivot relative to the base;

wherein the first and second tabs secure within the first and second grooves when the apparatus is in the folded position, thereby locking the door stop in a closed position via pressure between the first and second tabs and the first and second grooves;

wherein the elongated rigid body is configured to pivot more than 180 degrees into an open position of the door stop, thereby configuring the first and second tabs to rest on the bottom surface of the base to hold the elongated rigid body at an angle less than 90 degrees relative to the base; and wherein the open position provides an angle to wedge underneath a door.

* * * * *